United States Patent [19]

Ohgushi et al.

[11] Patent Number: 4,983,814

[45] Date of Patent: Jan. 8, 1991

[54] FIBROUS HEATING ELEMENT

[75] Inventors: Katsunori Ohgushi, Tokyo; Masao Hijiri, Otsu; Zenwemon Kitazawa, Gamou, all of Japan

[73] Assignee: Toray Industries, Inc., Tokyo, Japan

[21] Appl. No.: 352,668

[22] Filed: May 9, 1989

Related U.S. Application Data

[63] Continuation of Ser. No. 59,448, Jun. 8, 1987, abandoned.

[30] Foreign Application Priority Data

Oct. 29, 1985 [JP] Japan ..... 60-240351

[51] Int. Cl.[5] ..... H05B 3/34; H05B 3/54

[52] U.S. Cl. ..... 219/545; 219/543; 219/544; 338/22 R

[58] Field of Search ..... 219/553, 544, 543, 547, 219/545; 338/22 R, 225 D, 214

[56] References Cited

U.S. PATENT DOCUMENTS

| | | | |
|---|---|---|---|
| 3,349,359 | 10/1967 | Morey | 219/545 X |
| 3,472,289 | 11/1969 | Webber et al. . | |
| 3,973,234 | 8/1976 | Youtsey et al. | 338/214 X |
| 4,354,092 | 10/1982 | Dumas | 219/553 |
| 4,658,121 | 4/1987 | Horsma et al. | 219/553 |

FOREIGN PATENT DOCUMENTS

| | | |
|---|---|---|
| 2440428 | 3/1976 | Fed. Rep. of Germany . |
| 1349752 | 12/1963 | France . |
| 1548880 | 11/1968 | France . |
| 38-28382 | 12/1963 | Japan . |
| 42-8440 | 4/1967 | Japan . |
| 47-26023 | 8/1972 | Japan . |
| 51-36284 | 9/1976 | Japan . |

*Primary Examiner*—Bruce A. Reynolds
*Assistant Examiner*—Marvin M. Lateef
*Attorney, Agent, or Firm*—Armstrong, nikaido, Marmelstein, Kubovcik & Murray

[57] ABSTRACT

A fibrous heating element having an electrical resistance of 1 to 100 Ω/m is prepared by coating a core fiber, preferably a yarn, with one or more electroconductive layers consisting of a polyurethane resin having carbon particles dispersed therein. The fibrous element is pliable and can be knit or woven into a fabric, and is particularly suitable for use in an electric heating blanket or in an industrial heating element.

18 Claims, 3 Drawing Sheets

FIBROUS HEATING ELEMENT

This application is a continuation of application Ser. No. 059,448 filed June 8, 1987 now abandoned.

BACKGROUND

The present invention relates to a fibrous heating element which can be woven or knit into fabrics, such as fabric-forming yarns and can be attached to objects by sewing. The invention also relates to a method for the production of such a heating element, and a fabric heating element made with that fibrous heating element.

As means of heating or keeping various instruments and devices warm, flexible heating wires comprising a fine metal wire have been conventionally used. Such heating wires are widely utilized in various products such as electric blankets and carpets.

While Nichrome wires are conventionally used for the heating element in products which are required to be flexible, such as the above-mentioned household products, either a flexible core having a very fine resistance wire spirally would thereon or a fabric having carbon particles bonded thereon by a resin binder has been used as the heating element.

For example, in Japanese patent publication No. 52-14449 there is disclosed a planar heating element which comprises an electroconductive cloth of a glass-fiber fabric having tinned copper wires woven therein and coated with silicone-type electric conductive paint.

However, the known planar heating elements represented by the above example are poor in pliability, and they fail to meet required characteristics with respect to bend yield resistivity and friction or abrasion resistance. In addition they lack flexibility for apparel use or medical use.

There have been several attempts to obtain fibrous heating elements which comprise a pliable yarn coated with carbonaceous particles. For example, Japanese patent application Kokai (=laying-open) publication No. 51-109321 discloses an invention, according to which a conjugate filament having a sheath component of a low melting point is subjected to heating to have the sheath component swelled and to have carbonaceous particles attached to and/or contained in the filament. This heating element has a positive temperature coefficient of resistance and does not need temperature control means. However, according to the above method of having carbonaceous particles attached to filaments, particularly where the filaments have a large diameter, it is difficult to obtain a filament containing carbonaceous particles in a sufficient amount to provide the resistance value required for a heating element. According to an example recited in that publication, the filament obtained has an electric resistivity as high as $10^7$ Ω/cm, which is not satisfactory for a heating element.

Japanese patent publication No. 58-25086 discloses coating a fiber of a heat shrinkable polymer with an electric conductive layer and then heat-treating the fiber to obtain a product fiber having a low resistance value per unitary length. However, the invention of this publication is directed to an improvement in the electrostatic property of carpets, and the electric resistance value of the fiber obtained is only about $3.3\times10^7$ Ω/cm, and the products according to this invention are not useful as a heating element.

In Japanese utility model publication No. 38-1470, there is disclosed a pliable heating element which comprises a reinforcement fiber and a heating layer coated on the fiber, wherein the heating layer is an electric conductive rubber or plastic. However, the electric resistivity of the pliable heating element is only 50 to 100 Ω/cm, and it is ineffective as a heating element.

In Japanese utility model publication No. 40-15750, there is disclosed an electric conductive fiber which comprises an insulator fiber and electric conductive particles adhered to the insulator fiber. However, in this method, it is difficult to adhere carbon particles uniformly, and an electric conductive fiber having the required electric resistance value is difficult to obtain.

Japanese patent publication No. 46-23357 discloses a method of producing an electric conductive fiber, which comprises adhering a paste like mixture of a polyurethane, a solvent and electric conductive particles on a synthetic filament, and forming electric conductive coating by removing the solvent. However, the electric conductive fiber is intended to be anti-electrostatic, and the electric conductive fiber is not suitable for uses as a heating element because of its low electric resistivity of less than $10^9$ Ω/cm.

A first object of the present invention is to provide a fibrous heating element which has an electric resistance value higher than that of metals but lower than that of anti-electrostatic fibers, excellent flexibility and resistant to breaking on bending and abrasion, and which can be processed by weaving and knitting, and is usable as a sewing yarn or thread.

A second object of the invention is to provide a method for the production of such a fibrous heating element.

A third object of the invention is to provide a fabric heating element produced by forming the above fibrous heating element into a form of a pliable fabric, which can be attached to textile products such as clothes, for example, by sewing.

According to the present invention, the above objects have been attained by providing a fibrous heating element produced by coating a core fiber with at least one electric conductive layer of a polyurethane resin containing the carbonaceous particles dispersed therein.

The electric conductive layer according to the invention comprises a polyurethane resin containing carbonaceous particles dispersed therein, and gives a resistance element having a resistivity value remarkably greater than comparable values of metal resistance elements but lower than those of anti-electrostatic fibers. The heating element comprising a core fiber coated with at least one conductive layer according to the invention is pliable and resistant to breakage when bent or abraded, so that the fabric heating element made of such a fibrous heating element exhibits pliability and processability similar to those of conventional fabrics.

THE DRAWINGS

DESCRIPTION OF THE INVENTION

With reference to the accompanying drawings, the present invention will now be described in detail, and initially in connection with the fabric heating element made of the fibrous heating element of the present invention.

Figure 1:
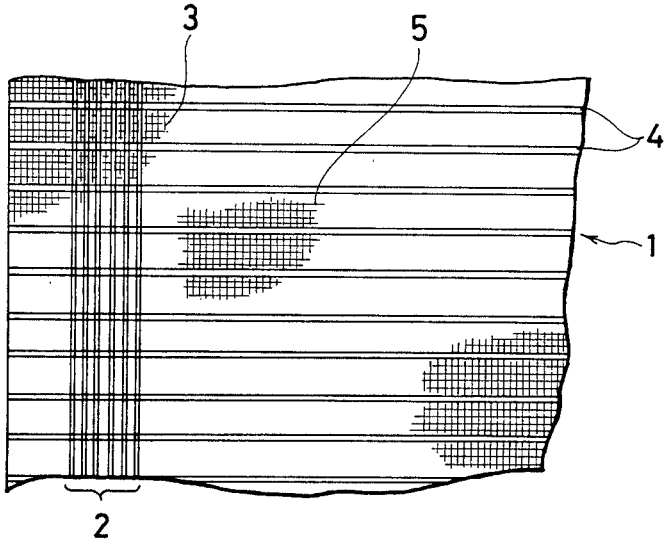
FIG. 1 is a plan view, taken for illustration of the structure of a fabric heating element comprising a woven fabric according to the present invention.

FIG. 1 is a partial plan view, showing an example of fabric heating elements according to the invention.

As shown in FIG. 1, the fabric heating element indicated at 1 consists of a woven fabric made of electrodes 2 in warps, which consist of a fine copper wire plated with tin, and nonconductive yarns 3 of, for example, a polyester fiber, and for the woofs fibrous heating elements 4 and nonconductive yarns 5 similar to the above yarns 3, the yarns 5 being incorporated in a proportion necessary for obtaining the desired amount of calories. This fabric can be produced by an ordinary loom. The electrode 2 is for supplying power to the fibrous heating elements 4.

The fabric heating element 1 can be formed on either one surface or both surfaces with a insulating layer (not shown) by coating a pliable insulating polymer, such as polyethylene, silicone resin or the like.

An insulating layer can be formed by suitable coating means depending on the particular resin or polymer to be used. Alternatively, both surfaces of the fabric heating element can be covered with a film of a thermoplastic resin and then heat cured to form an insulating layer. The thickness of the insulating layer should be adjusted taking into consideration the voltage of the power source to be used. In this connection, it may be advantageous to supply an insulating resin in a molten condition through a nozzle slit of a melt extruder to at least a portion of wire electrode of the fabric heating element, then optionally cover the formed layer of the insulating resin with a film of a thermoplastic resin, and press with cooled rollers, whereby it is feasible to obtain a fabric heating element in which the contact portions of wire electrodes and fibrous heating elements can always maintain close contact with each other. With the so produced fabric heating element, even if an external force is applied to bend it, when electric current is being supplied, there is no danger of sparks being generated, and the heating element is extremely safe.

The fabric heating element illustrated in FIG. 1 is very pliable, so that it is useful not only for electric heating blankets and carpets, clothes, medical auxiliary appliances, bedding, sofa material and so forth, but also for a heating source in a broad range of industrial materials, such as ones for deicing, de-frosting, de-dewing, drying and so forth.

Figure 2:
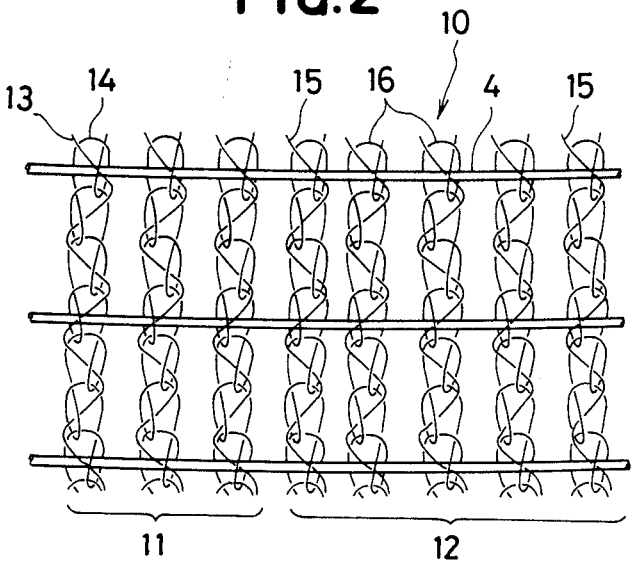
FIG. 2 is a plan view, taken for illustration of the structure of a mesh-fabric type heating element comprising a knit fabric according to the invention.

FIG. 2 illustrates the basic structure of fabric heating element 10 produced by Russel knitting in which woofs are laid in stitch. This heating element 10 consists of an electrode part 11 and a heat generating part 12, each of which consists of loop yarns and reinforcing yarns.

The electrode part 11 includes a reinforcing yarns 13, which comprises a single wire electrode or electrodes of, for example, a copper wire plated with tin and which is electrically connected to the fibrous heating elements 4 by loop yarns 14. The loop yarns should preferably also comprise electric conductive yarns.

The heat generating part 12 is made of a reinforcing yarns 15, generally of nonconductive yarns, such as polyester multifilaments and loop yarns 16. Further, this knit fabric can be made a mesh-type fabric by mesh-knitting with a conventional warp knitting machine. The fabric heating element according to the present invention can be produced in any other knit form than the one illustrated in FIG. 2 by any of the known knitting methods.

The fabric heating element according to the invention can be made in the form of a mesh knit fabric or a mesh woven fabric by any suitable means, and coated with an electrical material. The coating can be carried out by dipping the fabric in a molten resin or in a resin solution. A film of a thermoplastic resin may be applied on both surfaces of the fabric and the fabric heated to the melting point of the resin. By blowing air, or forming small holes by rolls provided with pins and then heating to the melting point, it is feasible to produce a coating having mesh openings.

As described above with reference to FIG. 1 and 2, the fabric heating element of the invention comprises a fabric which can be produced by an ordinary loom or knitting machine, so that it characteristically is possessed of a much higher pliability than conventional planar heating elements produced by forming a conductive layer on a nonconductive base material.

Moreover, where the fabric heating element of the invention is used for electric heating blankets or carpets, clothes or other similar goods, it can be combined with another material by sewing, as contrasted to conventional planar heating elements, so that it is highly advantageous from an industrial point of view.

Figure 3:
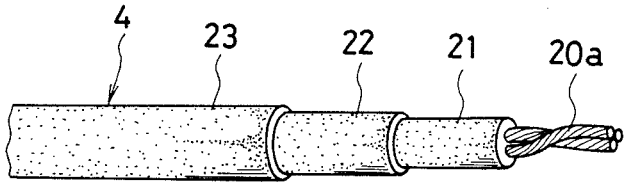
FIG. 3 is a partly broken-away perspective view, showing an example of fibrous heating elements according to the invention.
Figure 4:
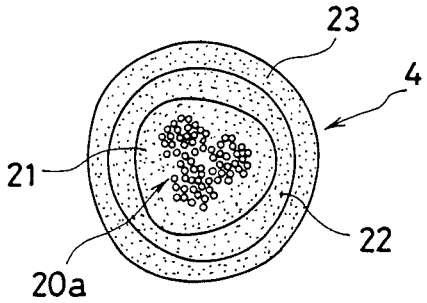
FIG. 4 is a sectional view of an example of the fibrous heating elements according to the invention.

FIG. 3 shows a partly broken-away perspective view of a fibrous heating element of the invention in which a three folded yarn is used as core fiber.

The fibrous heating element 4 comprises a core fiber 20*a* of three folded polyester yarn and electric conductive layers 21, 22 and 23 of a polyurethane polymer having carbonaceous particles dispersed therein, formed to cover the core fiber.

The core fiber has thickness usually within the range of 0.1 to 0.5 mmϕ, more preferably, in the range of 0.2 to 0.3 mmϕ, preferably in the form of a spun yarn, a double-structured yarn, or a textured yarn. Each of the above yarns has a large area for contact with the synthetic resin or polymer forming the electric conductive layer and adheres strongly to the resin.

For the above-mentioned yarns, there is preferably used a multi-folded yarn, particularly a two folded yarn or a three folded yarn. Three folded yarns in particular exhibit little surface irregularity due to twisting, and provide a fibrous heating element of high quality.

The above-mentioned double-structured yarn consists substantially of a non-twisted multi-filament as the core part and flock-like short fibers or a substantially non-twisted multi-filament as the sheath part wound on the surface of the core multi-filament.

When the above-mentioned double structured yarn is made of multi-filaments, it is feasible to minimize the elongation of the core fiber and prevent a change in the electric resistance value from occurring when the core fiber undergoes elongation. If the multi-filament has a number of twists exceeding 100 T/m, then core fibers made thereof generally tend to undergo undesirably large elongation and change its calorific value. Accordingly, the twist number should preferably be below the above recited value, more preferably 60 T/m or below. However, if the core fiber fails to have a good bundling property, the average thickness of the yarn tends to become very irregular and adversely affect the evenness of the thickness of the heat generating part or layer. Accordingly, rather than be completely devoid of twist, the multifilament should be twisted at a degree whereby a certain degree of the bundling property can be exhibited, for example 10 T/m.

The fiber forming the outer layer of the core fiber should preferably be of a shape suitable for adhesion to an electric conductive layer. For example, the outer layer may be made by interlacing a fiber surrounding the core fiber with an air jet, double-structured by twisting, or formed with loops of a textured yarn or a crimp yarn. For the core fiber in the present invention, use may be made of a plurality of the above-mentioned fibrous heating elements which are twisted together, making it possible to lower the resistance value per unit length.

While the fiber of the core fiber may be any natural fiber or synthetic fiber, the below mentioned fibers are preferred, depending on the intended use of the fibrous heating element.

Thermoplastic synthetic fibers are advantageously useful for they not only are heat resistant, non-hygroscopic, chemical resistant and less liable to deterioration by heat, but they also are capable of breaking by melting when a local overheating has taken place and function as a thermostatic fuse. Preferably, the fiber should be a nylon type fiber, a polyester type fiber or a polyolefin type fiber having a definite melting point.

Heat resistant fibers having an indefinite melting point, in contrast to the above-mentioned fibers, are desirable fibers in that they can provide a heating element for use in a high temperature range. Desirable fibers in this respect are, for example, polyfluoroethylene type fibers and wholly aromatic polyamide fibers. Particularly, the latter fibers can provide high tensile-strength fibrous heating element, and the heating element is suitable for industrial uses.

For the fiber in the core fiber, in addition to a fiber having an ordinary round cross-section, fibers may be used having a modified cross-sectional shape to obtain improved adhesion between the fiber and the conductive layer. Particularly where a multi-filament fiber is used, it is preferable that the fiber has a modified cross-sectional shape, for example, a triangular shape, a Y-letter shape, a T-letter shape, a +shape, a star shape or a wedge shape, or a U-letter shape, C-letter shape, a flat shape or a flattened concavoconvex shape. Fibers having such cross-sectional shapes may be used to form a core fiber in the form of either a group having the same cross-sectional shape or a mixture or a fiber blend of different cross-sectional shapes. For purposes of the present invention, where a fiber of a modified cross-sectional shape is used, the cross-sectional shape should preferably be such that, supposing the width of an open space between adjacent projections to be W, the height of projections to be H, the largest radius to be OR, and the cross-sectional area to be A, $H/W \geqq 0.6$, $H/R \geqq 0.7$ and $A/\pi R^2 \geqq 0.5$. Fibers meeting the above requirements can be preferably employed for the material for the core fiber according to the invention. If the distance of the open space between adjacent projections or branches W is sufficiently small relative to the height of the projections or branches (or the depth of concavities) H, the fibers have a higher anchoring property preventing the conductive layer from being stripped off the open space, and H/W should preferably be 0.6 or above or, more preferably, 0.8 or above. Fibers where the height of the projection or branch (or the depth of the concavities) is sufficiently great, and which have open spaces peripherally at many points, and where the longest radius in cross-section is R, H/R is preferably greater than 0.7. Furthermore, to let a small amount of the fiber occupy a large volume, it is preferable to set the cross-sectional area of the fiber, A, such that $A/\pi R^2$ is smaller than 0.5 inclusive or, particularly preferably 0.4 or below. Fibers having a modified cross-sectional shape as described above may be filaments, staple fibers or mixtures of them.

When use is made of a fiber of a synthetic polymer which contains a functional group directly bonded to a base polymer, an improvement is obtained in the adhesion of the fibrous heating element to the conductive layer. The functional group may be a peroxide group, a carboxyl group, a carbonyl group, a sulfoxide group, a hydroxide group, an amino group, an amide group, or a quaternary amino group. Those functional groups may be formed by an oxidation treatment, a decomposition treatment and a plasma treatment which is advantageous from the standpoint of mechanical characteristics.

The oxidation treatment involves oxidizing the fiber surface with an oxidizing agent and forming a functional group containing oxygen. Both conventional liquid-phase oxidation and gas-phase oxidation can be utilized.

The decomposition treatment forms terminal functional groups by decomposing the polymer. The alkaline decomposition of a polyester is a representative treatment of this type. In each of the above treatments, preferably, only the fiber surface should be treated.

For the plasma treatment, any of the methods usually employed in treating fibers can be used. When using the plasma treatment, the number of functional groups bonded to molecular chains on the surface (within 3000 Å) of a synthetic resin are increased. Using the appropriate ambient gas, it is possible to form carbonyl groups, carboxyl groups, hydroxyl groups, hydrooxyperoxide groups, amino groups, amide groups and so forth.

It is not necessary that the core fibers be in a bundled form. The fibers may be dispersed in the electric conductive layer providing a large area of contact between the monofilament fibers or fiber groups forming the core fiber and the electric conductive layer. If a stress is generated in the fibrous heating element, the stress is shared by each individual monofilament fiber or individual group of fibers, thereby improving the mechanical strength of the fibrous heating element.

To provide a fibrous heating element having structural features as described above, the core fiber may be made either of a yarn as spun and then drawn or of a yarn which has once been taken up on a bobbin and then unwound.

The core fiber can be treated by an agent having an affinity for both the polyurethane resin and the core fiber.

Any polyurethane resin can be used that retains stable electric resistance properties within the operating temperature range (20° to 100° C.), and melts or softens above the upper limit of the operating temperature. A suitable polyurethane resin is of the polyester type, the reaction product of a diisocyanate and a polyester type polyol obtained by reacting an acid with a diol component.

The above acid component comprises dicarboxylic acids such as adipic acid, sebacic acid and so forth, to which an aromatic dicarboxylic acid such as terephthalic acid, isophthalic acid and so forth may be added. The diol component is usually ethylene glycol, propylene glycol, 2,3-butanediol, caprolactonedio, polyethylene glycol, polypropylene glycol, polybutanediol and so forth.

For the isocyanate component, use is normally made of hexamethylene diisocyanate, tolyenediisocyanate, xylenediisocyanate, bis-4-isocyanate phenylmethane, isophoronediisocyanate and so forth.

Fine air bubbles formed in the electric conductive layer of the fibrous heating element of the invention improve its pliability.

In the fibrous heating element according to the present invention, the polyurethane resin forming the electric conductive layer may be made of a cross-linked structure, whereby an improvement can be attained in mechanical strength characteristics, thermal resistivity and solvent resistivity.

If cross-linking and depositing the resin on the core fiber are carried out simultaneously, viscosity increases through gelation as cross-linking proceeds. Thus, the cross-linking reaction should preferably be effected at the same time the electric conductive layer if formed, or after the electric conductive layer has been formed.

The cross-linking reaction can be a radical reaction, a reaction by electron beams and a photo reaction. The polyurethane resin obtained from the above exemplified components can be cross-linked using a cross-linking agent which provides radicals by abstracting hydrogen atoms from a methylene group such as benzoyl peroxide, one in which the polymer chain or side chain of the polymer is cut and re-oriented by electron beams such as $\tau$ rays, one in which a polyurethane prepared from a diol having double bonds, such as 1,2- or 1,4-polybutadiendiol, is subjected to radiation, and so forth.

By having the electric conductive layer cross-linked as above, it is possible to improve thermal resistivity, solvent resistivity, mechanical strength and so forth.

The following solvents and mixtures of these solvents, N,N-dimethyl-formamide, N,N-dimethylacetamide, dimethylsulfoxide, tetrahydrofuran, dioxane are available for use with polyurethanes. To coat large amounts of the electroconductive resin uniformly, the weight of solvent should be 1 to 10 times, preferably 2 to 6 times the weight of electroconductive resin.

Carbon black and/or graphite particles are used as the carbonaceous particles in the electroconductive resin. Suitable carbon blacks are, for example, acetylene black, channel black, furnace black and so forth. Mixture of these carbon blacks can also be used. The usual average particle diameter of carbon black(s) is within a range of 1 to 500 m$\mu$, preferably 5 to 300 m$\mu$, more preferably 10 to 200 m$\mu$, for good dispersion in the polyurethane resin.

Suitable graphites are, for example, block graphite, scaly graphite, powder graphite, or artificial graphite. Mixture of these graphite particles can also be used. The usual average diameter of graphite particles is within a range of 0.1 to 100 $\mu$m, preferably 0.2 to 50 $\mu$m, more preferably 0.5 to 20 $\mu$m are used, for good dispersion in the polyurethane resin.

The amount of the carbonaceous particles used is preferably 30 to 100 parts by weight or, more preferably, 40 to 60 parts by weight, to 100 parts by weight of polyurethane resin. With an amount less than 30 parts by weight, the resistivity of the fibrous heating element becomes too high and unsuitable for a heater. With an amount of more than 100 parts by weight, it is difficult to obtain a uniform resistivity, and properties such as bending resistivity and friction resistivity become low, because the amount of the polyurethane resin present is small.

When both carbon black and graphite are used as the carbonaceous particles, the weight ratio (carbon black/graphite particles) is preferably 1 to 4, more preferably 1.5 to 2.5. Over or under that range, the resistance value of the fibrous heating element becomes too high, and the resistivity of the fibrous heating element is not uniform.

While the fibrous heating element according to the present invention comprises one or more carbonaceous particle dispersion layer(s), 2 to 4 layers should preferably be formed by coating. This compensates for any irregularity in fiber diameter, and any irregularity in resistivity can be minimized. The concentration of the carbonaceous particles dispersed in the synthetic polymer layer can be varied from layer to layer as required.

The resistance value of the fibrous heating element of the invention can be set within a wide range by controlling the content of electric conductive particles in the synthetic polymer layer, and the number and the thickness of conductive layers coated. A practical range of the resistance value is on the order of 1 to 100 k$\Omega$/m, or, more preferably, 3 to 50 k$\Omega$/m. When the resistance value is smaller than 1 k$\Omega$/m, heating power per unit length becomes too high, and when the resistance value is larger than 100 k$\Omega$/m, heating power per unit length becomes too low, and the fibrous heating element is not suitable for heater.

To obtain the above resistance values and desired mechanical strength, the thickness of the electric conductive layer(s) is preferably 20 to 700 $\mu$m.

The thickness of the fibrous heating element is determined from the desired thickness of electric conductive layer(s) and the preferred fibrous heating elements have a thickness which can be used as components of fabric, and the range of thickness is 0.3 to 1.5 mm$\phi$.

The above described fibrous heating element according to the invention can be produced by the following steps:

Preparation of the core fiber: So that the core fiber can be prepared continuously, there is provided a yarn having no knots or like defects.

Preparation of the resin solution having carbonaceous particles suspended therein (hereinafter referred to as suspension): The resin is dissolved in an appropriate solvent usually at a solution viscosity of 20 to 100 poise (measured by B type viscometer). Then, carbonaceous particles are suspended in the solution and stirred, and the resulting suspension is placed in a closed vessel in order to prevent the solvent from evaporating. The solution viscosity is selected to be within a range in which the carbonaceous particles do not settle during processing.

The above prepared core fiber is coated by dipping in the suspension in the closed vessel while the suspension is stirred, taken out of the suspension and then passed through the die of an appropriate orifice diameter to control the amount of the suspension deposited. In order to enhance the mechanical strength of the heat generating layer, it is necessary that the individual fibers forming the core fiber to adequately wetted with the suspension, and the viscosity of the suspension and the orifice diameter of the die are adjusted accordingly. Industrially, it is preferable to employ a method in which the core fiber, taken up on a bobbin, is continuously withdrawn by a roller mechanism and dipped in the suspension.

After it has been coated, the core fiber is continuously subjected to a solvent removing process, such as drying or coagulation.

In the case of drying, the process is usually effected by a ventilation drying method, optionally heating the air to be supplied to promote drying.

In the case of coagulation, because uniform and fine bubbles are formed in the electroconductive layer(s), a flexible fibrous heating element can be obtained.

To compensate for any irregularity in the yarn diameter and/or in the resistance value and obtain fibrous heating elements of uniform characteristics, it is preferable to utilize plural electroconductive layers. To do this, the above described coating step including the solvent removing process is repeated. When the drying process is used to remove solvent, it is necessary that drying be sufficient so that the resin layer formed in a preceding step does not become dissolved in the suspension in a succeeding coating step.

The fabric heating element according to the present invention can be produced from the above described fibrous heating element by forming it into a woven or knit fabric using conventional methods. And when doing this, the fibrous heating element is generally disposed in the woof portion and the wire electrodes are generally disposed in the warp portion.

Fabric heating elements comprising a fabric made from the above described fibrous heating elements are generally structured such that a heat generating part comprising fibrous heating elements and nonconductive yarns is disposed between two electrodes. Thus, it is important to provide means for connecting the electrodes to an external power source.

Figure 5:
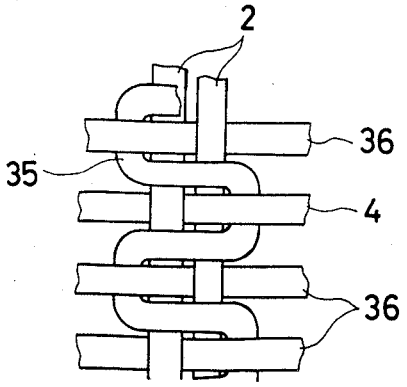
FIG. 5 shows a partial plan view of a fibrous heating element having an electrode part twined by binding yarn.

FIG. 5 illustrates an embodiment in which a binding yarn is used to fasten the wire electrodes 2 and the fibrous heating elements 4 together. The binding yarn 35 comprises a heat shrinkable yarn and is used at the portion in which the warp comprises the wire electrodes 2. Weaving is by letting the binding yarn 35 entwine all woofs which cross the electrode wires 2. The binding yarn 35 runs parallel with the fibrous heating element 4 and woofs 36 of nonconductive fiber stepping over the two wire electrodes 2 and being crossed with woofs and strongly pressing the wire electrodes 2 and woofs 36 against the warps. After weaving, heating will shrink the binding yarns and fasten the wire electrodes and the woofs. The above described manner of applying the binding yarn 35 can be applied also in the case of a knit fabric.

With woven or knit fabric heating elements as described above, the yarns crossing the wire electrodes make it difficult to attach lead wire to the electrodes for connection to a power source. Means for solving this difficulty will be described below.

One of the means consists in providing a fabric having the surfaces of the fibrous heating element and wire electrodes woven coated with an insulating material and applying a coating of a release agent or a covering of a protective layer at the predetermined locations between the wire electrodes and the insulating material. Generally the release agent is a silicone resin type agent or a fluorine resin type release agent. The covering may be made of a parting paper having a release agent coated on a rear face thereof. Use may also be made of a thin conductive foil or sheet, which may be double-folded and attached to the electrodes by any suitable means, for example, by soldering or by using a conductive bonding agent. When applying the covering, it may be desirable to partially expose the portion of the electrodes which is to be attached to the connection with the lead wires.

In an alternative means for the connection of electrodes to lead wires, use is made of two terminal plates, at least one of which has projections on its surface applied to the faces of the electrode in a manner such that the projections penetrate the electrode and tightly fasten the two terminal plates to each other. According to this method, even if the electrodes are covered with a resin film or a covering sheet, the desired electrical connection can be attained without removing the film or cover sheet.

Figure 6:
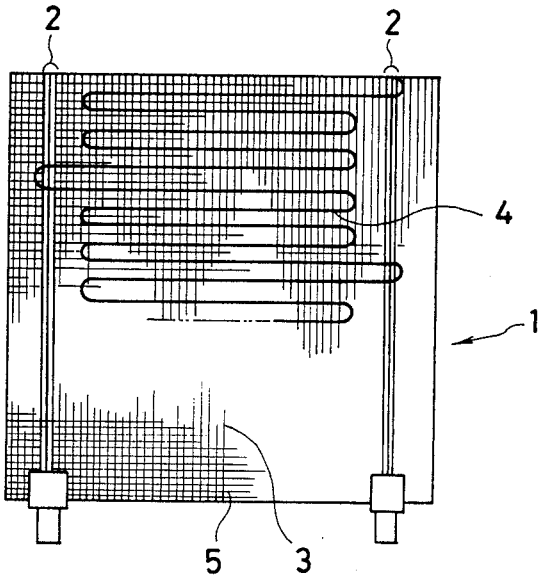
FIG. 6 is a view, illustrating the manner in which a long fibrous heating element is woven in within a short distance between electrodes.

Although the fibrous heating elements are usually arranged to form a parallel circuit as shown in FIG. 6, they may be run in a zigzag path between two electrodes along woofs so that they contact the electrodes intermittently to vary the amount of heat to be generated.

In a modified arrangement, the fibrous heating element may be used in both the warp and the woof providing power-source terminals at appropriate locations. The heating element may be wound about the steering wheel or hand of an automobile or motor bicycle to form a warming or heating face. As an alternative means of providing the fibrous heating element in a fabric, the element may be used as a sewing yarn or thread and sewn into the fabric.

A planar heating element comprising a fabric according to the present invention may be produced as a pattern of unitary heating elements in a fabric or in the form of having a repeating pattern, which may be cut to the desired length. It is possible to produce a fabric having strands of the electrode incorporated therein and cut this heating element along the warp direction into segments corresponding to the voltages desired. In this case, the number of patterns to be woven or knit can be reduced, and the cost of production can be lowered. Also in this case, those electrodes to which lead wires are not connected can be made functional to provide uniform electric current to the respective fibrous heating elements and to form bypath circuits in case of a local failure in electrical conduction.

It is feasible to incorporate a temperature control device known per se into the fabric heating element according to the present invention.

The characteristics of the fibrous heating element of the present invention will be described by means of the following examples:

EXAMPLE 1

Preparation of synthetic-polymer suspension 100 parts by weight of polyester type polyurethane resin (product of Dainichiseika Color & Chemicals MFG.Co., LTD) was uniformly dissolved in 540 parts by weight of a mixed solvent of methyl ethyl ketone, (hereinafter referred to as MEK) and dimethylformamide (hereinafter referred to DMF) (weight ratio of MEK/DMF:80/20). 50 parts by weight of carbon (black average particle diameter:40 mμ) and 30 parts by weight of graphite particle (average particle diameter:8.8 μm) are added and dispersed in the polyurethane, which had a viscosity of 45 poise at 30° C.

Coating conditions

While the above prepared dipping solution was being stirred, a two folded polyester spun yarn of 20-count was dipped in and passed through the solution at a rate of 2 m/min at 20° C., the amount of the solution deposited was adjusted through stainless steel dies having the orifice sizes shown in Table 1. Thereafter, the yarn was continuously passed through a hot air dryer maintained at 120° C. to form an electroconductive layer containing carbonaceous particles dispersed therein around the core fiber. The appearance and various characteristics of the fiber samples obtained by the above-described 1st stage drying and solidification procedure are shown in Table 1.

(1) From a comparison of Sample No. 1 (coated one time only), Sample No. 3 (coated twice) and Sample No. 4 (coated three times), each having essentially same amount of polymer deposited, it is seen that the urethane resin was more uniformly deposited in Sample No. 4 than in Sample No. 3, and that the deposit in Sample No. 3 was more uniform than in Sample No. 1. The same order was observed with regard to the uniformity of the diameter of the fibrous heating elements and the electric resistance per unit length.

(2) When a comparison was made of the electric resistance values of fibrous heating elements having the same amount of polymer deposited thereon, it was found that the electric resistance values were lower with those fibrous heating elements having the greater number of coating layers.

(3) By using plural coatings, irregularities on the surface were reduced and the surface of the fibrous heating element was made smooth and had low coefficient of friction, so that the element was readily processable for weaving or knitting.

TABLE 1

| Sample | Orifice diameter (mm ϕ) | Resin deposit amount (g/m) | Diameter of fibrous heating element | Electric resistance (kΩ/m) | Microscopic observation: Surface structure* | Microscopic observation: Sectional structure |
|---|---|---|---|---|---|---|
| 1 | 1.0 | 0.13 | 0.62 ± 0.15 | 22.5 ± 1.8 | Considerable | Rings of carbonaceous particles, observable on periphery |
| 2 | 0.8 | 0.12 | 0.55 ± 0.15 | 24.9 ± 2.0 | Considerable | Rings of carbonaceous particles, observable on periphery |
| 3 | 0.7 | 0.11 | 0.49 ± 0.11 | 27.8 ± 2.4 | Considerable | Rings of carbonaceous particles, observable on periphery |
| 4 | 0.5 | 0.085 | 0.43 ± 0.13 | 31.1 ± 3.1 | Considerable | Rings of carbonaceous particles, observable on periphery |

*Concavoconvex irregularities.

Repetitional coating conditions

Samples Nos. 3 and 4 in Table 1 were subjected to a 2nd stage treatment using the same dipping solution and in the same manner as above, except that for Sample No. 3 a die of an orifice size of 0.8 mm was used, while for the Sample No. 4 use was made of a die of an orifice size of 0.7 mm. Sample No. 4 was subjected to a 3rd stage treatment in the same manners as in the 1st and 2nd stage treatments, and in this 3rd stage, a die of an orifice size of 0.8 mm was used. The results are shown in Table 2.

Sample No. 2 was subjected to a 2nd stage coating with a solution having an 8.3 wt % concentration of carbonaceous particles suspended in a solution containing 16.7 wt % of the polymer. The properties of the treated fibrous heating element are shown in Table 3.

TABLE 3

| Sample (repeated. coating times) | Deposit amount of resin (g/m) | Electric resistance (Ω/m) | Surface structure (Smoothness) |
|---|---|---|---|
| 2 | 0.14 | 17.5 ± 0.9 | Superior to sample No. 2 (2 times) |

TABLE 2

| Sample (Repeated coating times) | Orifice diameter (mm ϕ) (1st/2nd/3rd) | Resin deposit amount (g/m) | Diameter of fibrous heating element | Electric resistance (kΩ/m) | Microscopic observation: Surface structure* | Microscopic observation: Sectional structure |
|---|---|---|---|---|---|---|
| 3 (1) | 0.7/1.0 | 0.13 | 0.56 ± 0.09 | 18.8 ± 1.2 | Not considerable | Rings of carbonaceous particles, observable both on outer periphery and in an inner layer |
| 4 (1) | 0.5/0.7 | 0.11 | 0.49 ± 0.09 | 25.7 ± 1.9 | Not considerable | Rings of carbonaceous particles, observable both on outer periphery and in an inner layer |
| 4 (2) | 0.5/0.7/1.0 | 0.13 | 0.55 ± 0.03 | 13.8 ± 0.5 | Concavoconvex irregularities, little | Rings of carbonaceous particles, observable both on outer periphery and in an inner layer |

*Concavoconvex irregularities.

On considering the data in Tables 1 and 2, the following desirable results of repeated coating were noted:

(1)

TABLE 3-continued

| Sample (repeated coating times) | Deposit amount of resin (g/m) | Electric resistance (Ω/m) | Surface structure (Smoothness) |
|---|---|---|---|
| | | | sample No. 4 (2 times) |

The bend strength and resistance to friction of Sample No. 3, Nichrome wire and a commercially obtained cord heater, were measured and the results are shown in Table 4.

TABLE 4

| | Resistance value (Ω/m) | Times of bending before break | Times of abrasion before break |
|---|---|---|---|
| Nichrome wire | | | |
| (0.1 mm ϕ) | 154 | 2–3 | 2 |
| (0.32 mm ϕ) | 18 | 3 | |
| Commercially obtained cord heater (2.1 mm ϕ) | 46–48 | 200–300 | — |
| Fibrous heating element (0.56 mm ϕ) | 13,000–14,000 | 3,000–5,000 | 122 |

From Table 4, it is seen that the fibrous heating element according to the present invention is exceptionally durable in comparison to a conventional wire heater.

EXAMPLE 2

Three different solutions having carbonaceous particles at concentrations of 12 wt %, 10 wt % and 5 wt % were prepared using the procedure of Example 1. The ratio, carbon black/graphite particles, was 2/1.

A core fiber of three folded polyester spun yarn (30-count) was dipped in and passed through the suspension containing 12 wt % of carbonaceous particles maintained at 20° C. at a rate of 2 m/min, then the amount of the dipping solution deposited on the core fiber was adjusted through a die, and the yarn was continuously dried in a drier having its temperature maintained at 120° C., to obtain a fiber coated with a layer of polymer having carbonaceous particles dispersed therein. The procedure was repeated using the suspension containing 10 wt % of carbonaceous particles and then the suspension containing 5 wt % of carbonaceous particles, to obtain a fibrous heating element having three coating layers with carbonaceous particles dispersed therein. The fibrous heating element thus obtained was found to be high in pliability, remarkable in bending resistivity and friction resistivity, and have 12.8 KΩ/m as its electric resistance value.

EXAMPLE 3

A double-structured yarn (0.6 mmϕ) consisting of polyester multi-filament (75D-25fil) as its core part and polyester staples (3d, 1.5 inch) as its sheath part, wound on the surface of the multi-filament core, was used as a core fiber. Except for changing the core fiber, a fibrous heating element was prepared using the same process as Example 2. The fibrous heating element thus obtained was found to be high in pliability, remarkable in bending resistivity and friction resistivity, and having 10.8 KΩ/m for the electric resistance value.

EXAMPLE 4

A three folded polyester textured yarn whose cross-sectional shape is 8 leafs' type (0.56 mmϕ) was used as a core fiber. Except for changing the core fiber, a fibrous heating element was prepared using the same process as Example 2. The fibrous heating element thus obtained was found to be high in pliability, remarkable in bending resistivity and friction resistivity, and have 14.2 KΩ/m for the electric resistance value.

EXAMPLE 5

A two folded wholly aromatic-polyamide spun yarn (20-count, 0.56 mmϕ) was used as the core fiber. Except for changing the core fiber, a fibrous heating element was prepared using the same process as Example 2. The fibrous heating element thus obtained was found to be high in pliability, remarkable in bending resistivity and friction resistivity, and have 11.6 KΩ/m for the electric resistance value.

EXAMPLE 6

100 parts by weight of polyester type polyurethane resin (product of Dainichiseika Color & Chemicals (MFG.Co., LTD) was uniformly dissolved in 500 parts by weight of mixed solvent of MEK and DMF (weight ratio of MEK/DMF: 10/90). 50 parts by weight of carbon black (average particle diameter: 40 mμ) and 30 parts by weight of graphite particle (average particle diameter: 8. μm) were added and dispersed in the polyurethane solution. The solution had a viscosity of 80 poise at 30° C., as measured with a B type viscometer.

While the above prepared dipping solution was being stirred, a two folded polyester spun yarn of 20-count was dipped in and passed through the solution at a rate of 10 m/min at 20° C., and the amount of the solution, deposited was adjusted by stainless steel dies of orifice size 0.6 mmϕ. The dispersion deposited on the yarn was coagulated by being continuously passed through a coagulation bath of DMF aqueous solution (weight ratio of DMF/water:2/98) maintained at 20° C., and the solvent was removed by being passed through a solvent-removing bath of water. The thus treated yarn was dried using a Nelson type drying roller maintained at 120° C. The fibrous heating element produced had a diameter of 0.5 mmϕ, and an electric resistance value of 16 kΩ/m.

EXAMPLE 7

Using Sample No. 4 prepared in Example 1 and a 4-count polyester spun yarn for woofs, and polyester filament (150D-50fil) and tin-plated copper wires (0.1 mmϕ) for warps, a plain woven fabric was produced in the usual manner weaving the fibrous heating element in one in every three woofs of the count-4 polyester spun yarn. Also, tin-plated copper wires were disposed in twenty warps at each of the sides of the fabric, inside of edges of the warps, to form wire electrodes. The distance between the two electrodes was set to be 10 cm.

To a portion of the wire electrodes of the woven fabric obtained above, molten polyethylene having a melt index of 3.7 g/10 min and a density of 0.923 g/cm$^3$ was supplied at 310° C. through the nozzle slit of a melt extrusion laminator. At the same time, both faces of the fabric were covered with a polyester film of a thickness of 25 μm, and then a pressure of 10 kg/cm was applied to the fabric by water cooled rollers maintained at 30° C., to form an insulating film and to obtain a fabric heating element 20 cm in length and 11 cm in width. A heater was made by connecting lead wires to the above obtained fabric heating element. The fabric heating element had a resistance value of 14 Ω and was pliable and capable of being sewn like ordinary fabrics in general.

As can be understood from considering the results of the above examples, the fibrous heating element described is useful as heat generating element in a variety of goods such as (1) winter clothes, outer-garments for riders, fishermen, divers and so forth, inner garments, work clothes, underwear and so forth; (2) in furniture and bedding, such as carpets, blankets, lap robes, seating material for railway passenger cars and automobiles; (3) in the medical field for medical-care supporters, belly bands, warming mats and sheets and so forth; (4) for household goods, such as gloves, shoes, socks, cushions and so forth; (5) in construction materials, such as flooring, wall, floor warmers and so forth; (6) in electric appliances, such as electrical instruments and appliances, heating members for meters and so forth; (7) in agriculture and civil engineering, such as bed warming sheets, maturing sheets and so forth.

We claim:

1. A fabric heating element comprising fibrous heating elements and wire electrodes, wherein each of the fibrous heating elements comprises a core fiber coated with one or more electroconductive layers consisting of a polyurethane resin having carbon particles dispersed therein.

2. A fabric heating element as claimed in claim 1, wherein the core fiber is a spun yarn, a double-structured yarn, a multi-filament yarn or a textured yarn.

3. A fabric heating element as claimed in claim 1 or 2, wherein the fibrous heating elements and the wire electrodes are crossed.

4. A fabric heating element as claimed in claim 1 or 2, which is formed by weaving.

5. A fabric heating element as claimed in claim 1 or 2, which is formed by knitting.

6. A fabric heating element as claimed in claim 4, wherein the wire electrodes are woven in as warps, which are fastened by a tangling yarn comprising a heat-shrinkable fiber.

7. A fabric heating element as claimed in claim 6, wherein the heat-shrinkable fiber is shrunk after weaving.

8. A fibrous heating element comprising a core fiber consisting of a synthetic fiber coated with at least two layers of a polyurethane resin containing 30 to 100 parts by weight of at least one kind of carbon particles dispersed therein, based on 100 parts by weight o the polyurethane resin, and having an electrical resistivity of 1 to 100 kΩ per meter.

9. A fibrous heating element as claimed in claim 8, wherein the core fiber is a spun yarn, a double-stranded yarn or a textured yarn.

10. A fibrous heating element as claimed in claim 8 or 9, wherein the core fiber has a triangular, Y-shaped T-shaped, cruciform-shaped, star-shaped, wedge-shaped, U-shaped, C-shaped, flat-shaped or concavoconvex-shaped cross-section.

11. A fibrous heating element as claimed in claim 8, wherein the synthetic fiber has a definite melting point.

12. A fibrous heating element as claimed in claim 8 wherein the synthetic fiber has an indefinite melting point.

13. A fibrous heating element as claimed in claim 8, wherein said at least two layers contain air bubbles.

14. A fibrous heating element as claimed in claim 8, wherein the polyurethane resin is cross-linked.

15. A method for the production of a fibrous heating element which comprises the steps of dipping a core fiber in a solution of a polyurethane resin containing 30 to 100 parts by weight of at least one kind of carbon black therein per 100 parts by weight of the polyurethane resin to deposit solution on the core fiber, solidifying the solution deposited on the core fiber, and repeating the steps of dipping the core fiber in the solution and solidifying the solution deposited on the core fiber at least once.

16. A method as claimed in claim 15, wherein the solidifying step comprises drying the solution deposited on the core fiber.

17. A method as claimed in claim 15, wherein the solidifying step comprises coagulating the solution deposited on the core fiber.

18. A method as claimed in claim 15, wherein the polyurethane resin is cross-linked after is has been deposited on the core fiber.

* * * * *